US006279972B1

(12) United States Patent
Brill et al.

(10) Patent No.: US 6,279,972 B1
(45) **Date of Patent: *Aug. 28, 2001**

(54) CLOSING DEVICE FOR A MOVABLE ELEMENT, IN PARTICULAR FOR A DOOR OF A VEHICLE

(75) Inventors: Sigmar Brill, Horhausen; Reinhard Stalter, Usingen; Gerhard Menz; Klaus Rathmann, both of Frankfurt; Axel Schäfer, Kriftel, all of (DE)

(73) Assignee: Mannesmann VDO AG, Frankfurt am Main (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/344,184

(22) Filed: Jun. 24, 1999

(30) Foreign Application Priority Data

Jun. 25, 1998 (DE) ..... 198 28 202

(51) Int. Cl.[7] ..... E05C 3/06
(52) U.S. Cl. ..... 292/216; 70/280
(58) Field of Search ..... 292/201, 216; 70/267, 270, 280; 318/599, 811

(56) References Cited

U.S. PATENT DOCUMENTS

| | | | | |
|---|---|---|---|---|
| 4,400,654 | * | 8/1983 | Elliott | 318/312 |
| 4,979,384 | * | 12/1990 | Malesko | 70/241 |
| 5,001,407 | * | 3/1991 | Suzuki | 318/268 |
| 5,091,679 | * | 2/1992 | Murty | 318/153 |
| 5,406,440 | * | 4/1995 | Wieloch | 361/154 |
| 5,429,400 | * | 7/1995 | Kawaguchi | 292/201 |
| 5,613,716 | * | 3/1997 | Cafferty | 292/216 |
| 5,699,685 | * | 12/1997 | Jahrsetz | 70/264 |
| 5,793,173 | * | 8/1998 | Henschel | 318/467 |
| 5,901,991 | * | 5/1999 | Hugel | 292/201 |

FOREIGN PATENT DOCUMENTS

| | | |
|---|---|---|
| 4228233 | 3/1994 | (DE) . |
| 4318544 | 5/1994 | (DE) . |
| 19604724 | 8/1997 | (DE) . |

OTHER PUBLICATIONS

Electronik; 5 pages.
Getriebetechnik by Johannes Volmer; 10 pages.
German Search report; 3 pages.

* cited by examiner

*Primary Examiner*—Gary Estremsky
(74) *Attorney, Agent, or Firm*—Mayer, Brown & Platt

(57) ABSTRACT

The invention relates to a closing device for a movable element, in particular for a door, a flap or the like, of a vehicle, having a rotary latch which arrests or releases a closing bolt, it being possible for the rotary latch to be arrested by a detent pawl to effect a closed position of the element and it being possible for the detent pawl to be driven by an actuating drive for the purpose of releasing the rotary latch to effect an opening position of the element, the invention making provision for means which control the actuating drive in such a manner that after the actuating drive has been driven from a rest position in the direction of a working position for the purpose of releasing the rotary latch it is returned in a controlled manner from the working position into the rest position.

8 Claims, 3 Drawing Sheets

CLOSING DEVICE FOR A MOVABLE ELEMENT, IN PARTICULAR FOR A DOOR OF A VEHICLE

BACKGROUND OF THE INVENTION

The invention relates to a closing device for a movable element, in particular for a door, a flap or the like, of a vehicle.

A closing device of this type is disclosed in DE 42 28 233 A1. This document describes lock elements, such as a detent pawl, a rotary latch and a closing bolt which interacts with the rotary latch, for locking or unlocking the movable element. The rotary latch is arrested by the detent pawl and in the process surrounds the closing bolt in such a manner that the door is locked. An actuating drive which acts on an arm of the detent pawl is provided for releasing the rotary latch and hence also the closing bolt for the purpose of opening the door. The actuating drive is driven by a switch which is actuated as a function of a handle, such as a door handle, being actuated.

DE 42 28 233 A1 shows the actuating drive as a solenoid having an extendable ram, the ram acting upon one arm of the detent pawl. After current is supplied to the actuating drive, the ram extends and in doing so moves the detent pawl in such a manner that the latter releases the rotary latch in order to be able to unlock the door. After this procedure, or after currentless switching of the actuating drive, the ram returns into its starting position. In the process, it may happen that the ram, during the movement from its working position (actuation of the detent pawl) into its rest position, dynamically rebounds against a stop in this rest position and the detent pawl is thereby partially or completely activated to effect a further release of the rotary latch. This procedure is called apparent closing, this apparent closing constituting a safety risk since the door has possibly again to be closed during this apparent closing but this is not possible since the rotary latch is unable to be arrested by the detent pawl which has been brought into its release position. It goes without saying that an unlocked door or the like, which can thus be opened at any time or is open, constitutes a high safety risk.

There is thus a need for a closing device for a movable element, in particular for a door, a flap or the like, of a vehicle, which effectively prevents the above-described apparent closings.

Other needs will become apparent upon a further reading of the following detailed description taken in conjunction with the drawings.

SUMMARY OF THE INVENTION

In one form of the invention, the aforementioned needs are fulfilled by providing means which control the actuating drive in such a manner that after the actuating drive has been driven from a rest position into a working position for the purpose of releasing the rotary latch it is returned in a controlled manner again from the working position into the rest position. This controlled return from the working position into the rest position ensures that the actuating drive, in particular an actuating element, such as the ram, which acts within the actuating drive, or else an actuating element which is separate from the actuating drive, is not able, once the rest position is reached, to rebound in the direction of the working position but rather remains in this rest position. The drive is thus to be designed in such a manner that this rebounding is completely suppressed or rebounding is permitted only to an extent which is unable to result in the detent pawl being actuated to effect the release of the rotary latch.

A control of this type can, for example, be carried out in that the movement of the actuating drive or of its actuating element from the working position into the rest position is detected and after a certain distance has been covered to reverse the polarity of the control variable in order to achieve a braking effect. A further possibility resides in the actuating drive being driven by a certain control variable for the purpose of actuating the detent pawl and being driven by the same control variable with reverse poles for the purpose of returning it.

In a development of the invention, the actuating drive can be controlled by pulse-width modulation. A pulse-width modulated control signal for the actuating drive advantageously provides a control signal which can be adapted to a very wide variety of conditions. The pulse-width modulation can be adapted to various actuating drives so that the type of actuating drive used (such as, for example, a solenoid, electric motor or the like) is insignificant. In addition, by changing the pulse width for the very different actuating drives and the very different designs of the closing device, in particular with regard to its geometrical shape, the control signal can be optimally adapted to the prevailing circumstances.

In a development of the invention, the pulse width when driving the actuating drive from its rest position into the working position is smaller than the pulse width when driving the actuating drive to reach the rest position. The result is that in order to open the movable element (by driving the detent pawl which in turn releases the rotary latch), after the actuating drive has been driven it drives the detent pawl of the rotary latch in the shortest possible time. If the same signal as when driving the actuating drive for the purpose of obtaining a movement from the rest position into the working position were used in the reverse direction, it would lead to the already described, disadvantageous rebounding and thus to a risky apparent closing.

This is effectively avoided in that when the actuating drive returns, i.e. when it moves from the working position into the rest position, the speed of the actuating drive or of its actuating element is reduced in order to avoid the rebounding. At this point it is also conceivable that if the detent pawl is forced in the direction of the arresting position for the rotary latch by a restoring force, the actuating drive can be driven, in the movement to reach the rest position, by a control signal which does indeed counteract this restoring force but this restoring force is larger than the counterforce of the driven actuating drive or of its actuating element. By virtue of these two forces acting against each other with the restoring force for the detent pawl being larger, a damped movement of the actuating drive or of its actuating element in the direction of the rest position is advantageously achieved.

In a development of the invention, the pulse width when driving the actuating drive to reach the rest position can be changed. If the pulse width is selected such that a rapid movement is initially achieved during the movement from the working position into a rest position and shortly before the rest position is reached the pulse width is reduced, the effect is advantageously achieved thereby that the actuating drive or its actuating element is initially moved rapidly out of the region in which the detent pawl is arranged, and a reduction of the pulse width of the control signal results in the actuating drive or its actuating element being slowed down. This changeability to the pulse width can be carried out continuously or discontinuously over the region between the working position and the rest position.

In a development of the invention, the actuating drive is assigned a drive module, in particular an end stage, for the actuating drive, which module together with the actuating drive and optionally other parts of the closing device, is arranged in a housing. This has the advantage that the above-mentioned closing device can be designed and pre-assembled as a complete module which is subsequently inserted in the door, the flap or the like of the vehicle. Then, especially when using means for detecting the actuation of a handle (for example, door handle), as a function of which the actuating drive is driven, only electrical cabling is still required. For this purpose, the housing can have a plug or a bushing or the like via which the closing device has to be connected to the remaining elements mentioned.

In a development of the invention, the actuating drive is assigned a drive module which is a component part of a central control device. In this case, the signals of the means which detect the actuation of the handle are detected and evaluated in the central control device, and then, as a function of the evaluation—optionally taking into consideration whether the actuating drive should be driven at all or not (as, for example, in the case of theft protection)—a corresponding control signal is output to the actuating drive of the relevant movable element via the internal drive module.

DETAILED DESCRIPTION OF THE PREFERRED EMBODIMENT

Figure 1:
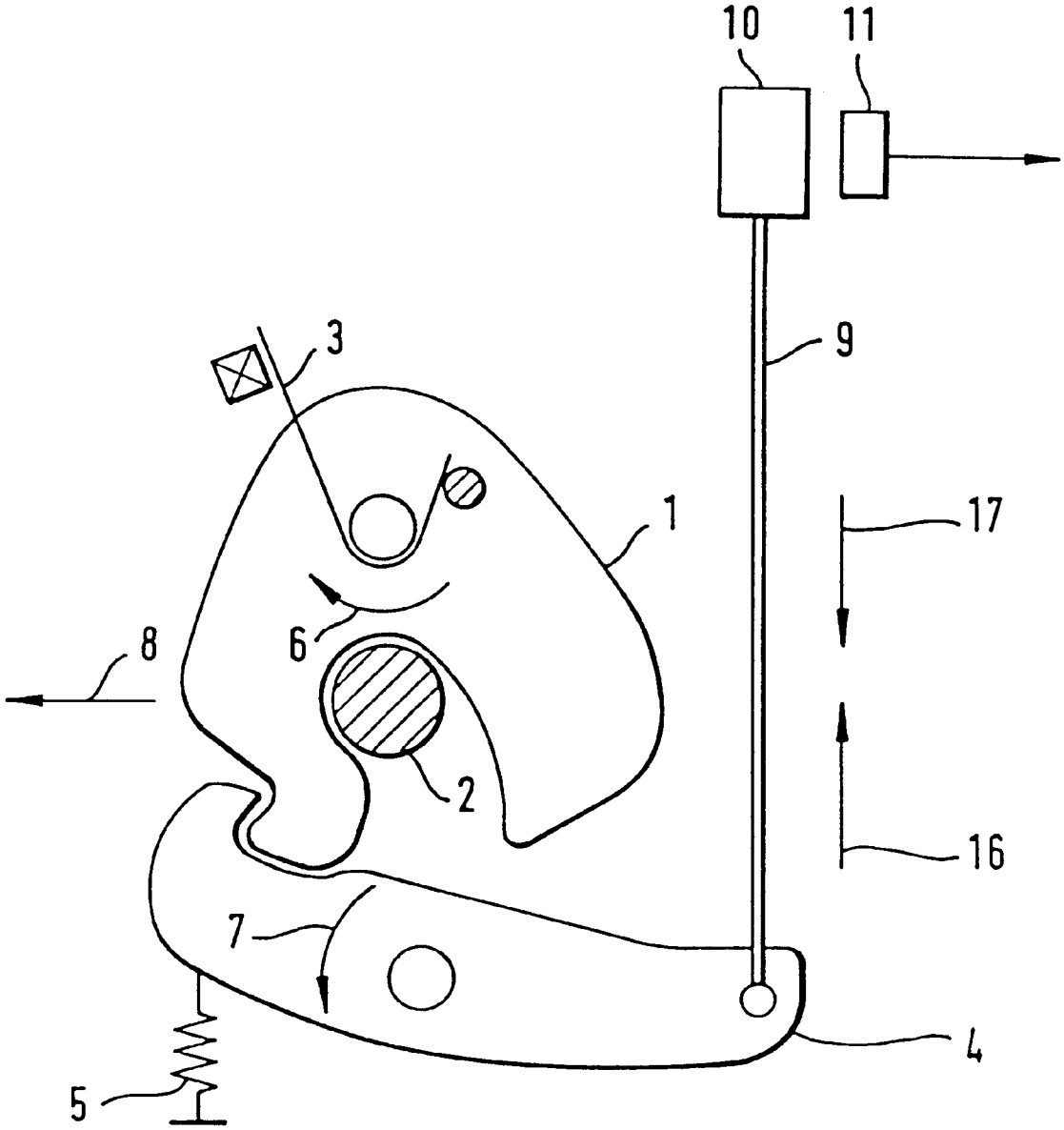
FIG. 1 shows plan view of a closing device.

While the present invention is capable of embodiment in various forms, there is shown in the drawings and will be hereinafter described a presently preferred embodiment with the understanding that the present disclosure is to be considered as an exemplification of the invention, and is not intended to limit the invention to the specific embodiment illustrated.

FIG. 1 shows, by way of an example, a closing device for a door, in particular for a motor vehicle door, the invention not being used solely for this mechanism but also for mechanisms of a similar or different nature.

A rotatably mounted rotary latch 1 surrounds, with its two limbs, a latch striker 2, the rotary latch 1 being pretensioned by means of a rotary-latch spring 3. A detent pawl 4, which is likewise spring-loaded, interacts with the rotary latch 1, this spring, in the refinement according to FIG. 1, being designed as a compression spring 5 and pressing a lever arm of the detent pawl 4 in the direction of one limb of the rotary latch 1. The reference number 6 denotes a rotational direction of the rotary latch 1, the reference number 7 a rotational direction of the detent pawl 4 and the reference number 8 a direction of movement of the latch striker 2 which is fixed on the door (which is not described in more detail), the direction of movement 8 constituting opening of the door. FIG. 1 shows the position of the closed door. The spring loading of the detent pawl 4 can also be realized by means of a tension spring.

In the exemplary embodiment shown in FIG. 1, the detent pawl 4 is connected to an actuating drive 10 via connecting elements (connecting rod 9 or else Bowden cables), this actuating drive 10 being assigned a sensor 11 for detecting the actuation of a handle (not shown), and proceeding from a signal of the sensor the means can be actuated.

A further opening direction 16 and a closing direction 17 are indicated in FIG. 1, so that after the actuating drive 10 has been driven, it moves the detent pawl 4 in the opening direction 16 so that the detent pawl 4 releases the rotary latch 1.

Figure 2:
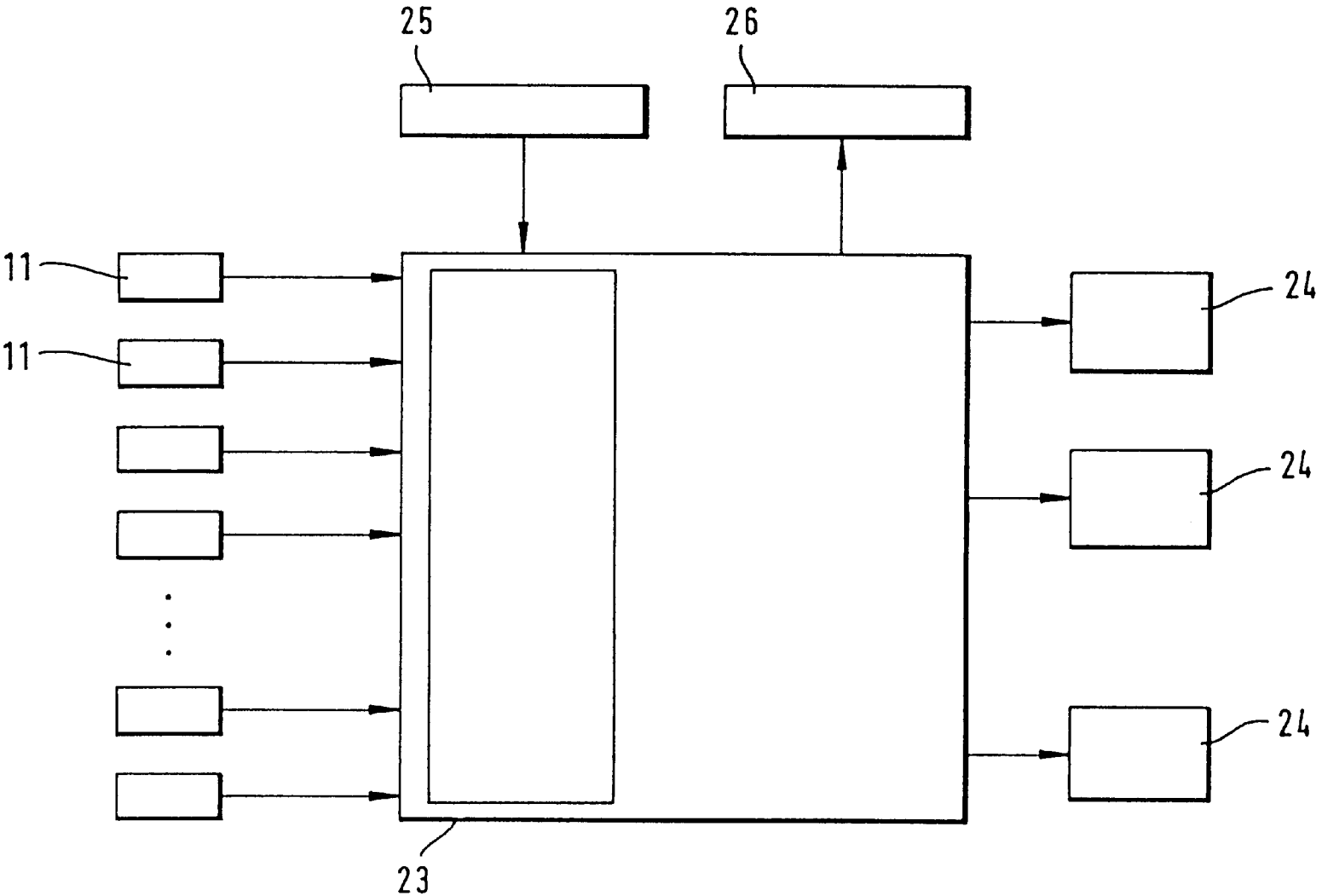
FIG. 2 shows a schematic view of a central control device.

FIG. 2 shows a control device 23 to which the sensors 11 are connected for detecting the actuation of the handle. In this case, a respective sensor 11 corresponds to one handle, such as the door inside handle or door outside handle. The number of handles and of sensors 11 can be selected as a function of the number of doors (or else rear flap, glove compartment, gas tank flap or the like). Every two sensors 11 (door inside handle, door outside handle) are assigned a drive module 24 which drives the particular actuating drive 10, the actuating drive 10 being able to be arrested in its two end positions or being self-locking and currentless.

The control device 23 is furthermore assigned an input device 25 via which the actuating requirements can be passed to the control device 23. This can take place, for example, by means of manual input, and as an alternative or supplement thereto, moreover, under remote control. Thus, for example, the switching-over from theft protection position to central locking position can take place through the use of a manual transmission whereas to set the child safety catch position an input button can be provided. The reference number 26 denotes an output device by means of which, for example, a status display (for example, child safety catch on/off) is possible.

The control device 23 operates as follows: The control device 23 checks which actuating requirement has been set via the input device 25. As a function thereof, the drive module 24, which can also be integrated in the control device 23 or in the actuating drive 10, is either driven or is not.

It is conceivable for two handles to jointly act on the detent pawl via connecting elements, or else for one handle in each case to be connected by connecting elements to the detent pawl so that separate actuation (for example, required for realizing the child safety catch) is made possible.

Figure 3:
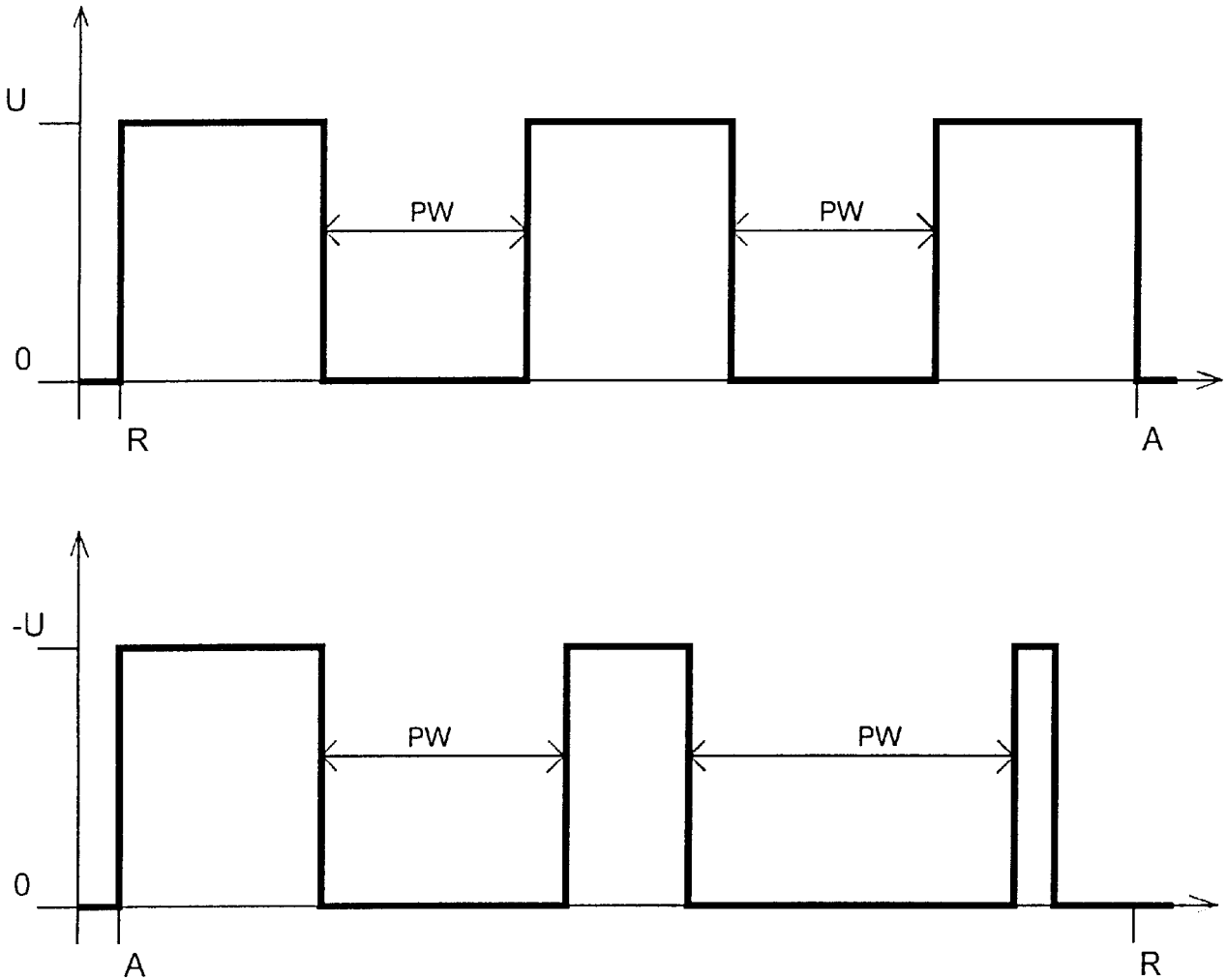
FIG. 3 shows a signal sequence for driving the actuating drive.

FIG. 3 shows a signal sequence for driving the actuating drive 10, the upper half of FIG. 3 showing that the actuating drive 10 is driven by a square wave signal having the amplitude U, the driving taking place in such a way as to bring the actuating drive 10 or its actuating element from a rest position R, which is shown in FIG. 1, into a working position A. The square wave signal shown is just an example to clarify the mode of operation, substantially more square wave pulses being required to drive the actuating drive in an actual embodiment. The pulse width PW of the square wave signal shown in the upper part of FIG. 3 is selected such that the width of the drive pulses is identical to the length of the pulses while no driving is taking place (amplitude of the signal=0).

The lower half of FIG. 3 shows the control signal for the actuating drive 10 by which said actuating drive is driven in order to move it, or its actuating element, from the working position A into the rest position R. In this case, it is shown by way of example that the pulse width PW when the actuating drive 10 is being driven from its working position A is initially larger than when the actuating drive is being driven to reach the rest position R. For clarification purposes, the length of the drive signal is also to be understood here under pulse width PW while the actuating drive 10 is not being driven, i.e. when the amplitude of the drive signal=0. If the pulse width is related to the width of the signal by which the actuating drive 10 is driven, the choice of words is just the other way round.

The lower half of FIG. 3 thus reveals that at the beginning of the phase during which the actuating drive 10 or its actuating element is still situated in the working position A, a relatively long driving takes place (with opposed amplitude –U) in order to move said actuating drive in the direction of the rest position R. During the movement of the actuating drive 10 or its actuating element in the direction of the rest position R, the pulse width PW of the pulses with the amplitude=0 is then increased so that the speed is reduced and the rest position R is reached without any rebounding happening or only a slight rebounding happening which does not, however, have any effect on the detent pawl 4. Shortly before the rest position R is reached, provision can also be made for the actuating drive 10 to be driven with a short pulse or with short pulses having the amplitude U or else a smaller amplitude, which pulses would cause the actuating drive 10 to move from the rest position R into the working position A so that the energy of these short pulses reduces or dissipates the momentum.

The foregoing description of a preferred embodiment of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

What is claimed is:

1. A closing device for a movable element comprising:

a detent pawl;

latch striker;

a rotary latch which arrests or releases the latch striker, wherein the detent pawl arrests or releases the rotary latch;

an actuating drive, wherein the actuating drive includes a rest position and a working position and wherein the actuating drive actuates the detent pawl;

a control device which uses pulse-width modulation to control the actuating drive from its rest position to its working position and for controlling the return movement of the actuating drive back to its rest position without substantial rebound, wherein the pulse width when driving the actuating drive from its rest position is smaller than the pulse width when driving the actuating drive to reach the rest position.

2. The closing device as claimed in claim 1, wherein the pulse width when driving the actuating drive to reach the rest position can be changed.

3. The closing device as claimed in claim 1, wherein the actuating drive is driven by a drive module.

4. The closing device as claimed in claim 2, wherein the actuating drive is driven by a drive module.

5. The closing device as claimed in claim 1, wherein the actuating drive is driven by a drive module which is a component part of a central control device.

6. The closing device as claimed in claim 2, wherein the actuating drive is driven by a drive module which is a component part of a central control device.

7. The closing device as claimed in claim 3, wherein the actuating drive is driven by a drive module which is a component part of a central control device.

8. The closing device as claimed in claim 4, wherein the actuating drive is driven by a drive module which is a component part of a central control device.

* * * * *